US006622857B2

(12) United States Patent
Ohtsubo et al.

(10) Patent No.: US 6,622,857 B2
(45) Date of Patent: Sep. 23, 2003

(54) COMPRESSION STORAGE BAG

(75) Inventors: Ryoichi Ohtsubo, Sakurai (JP); Yoshihiro Koyanagi, Kashiwara (JP)

(73) Assignee: Aru Corporation, Osaka (JP)

( * ) Notice: Subject to any disclaimer, the term of this patent is extended or adjusted under 35 U.S.C. 154(b) by 0 days.

(21) Appl. No.: 10/012,559

(22) Filed: Dec. 12, 2001

(65) Prior Publication Data

US 2002/0079242 A1 Jun. 27, 2002

(30) Foreign Application Priority Data

Dec. 22, 2000 (JP) ..... 2000-391127

(51) Int. Cl.[7] ..... B65D 85/18
(52) U.S. Cl. ..... 206/287; 206/288
(58) Field of Search ..... 206/287, 524.8, 206/522, 829, 438, 288–291, 300, 284, 285; 383/103, 100, 3, 39, 40, 44; 223/91, 96, 85, 90, 93; 248/95, 100, 101

(56) References Cited

U.S. PATENT DOCUMENTS 2,964,197 A * 12/1960 Wallace ..... 211/45
3,738,550 A * 6/1973 Van Etta et al. ..... 223/85
3,958,696 A * 5/1976 Leonas ..... 211/45
5,094,414 A * 3/1992 Eddy, Jr. ..... 248/95
5,240,112 A * 8/1993 Newburger ..... 206/524.8
5,540,500 A * 7/1996 Tanaka ..... 383/43
5,544,752 A * 8/1996 Cox ..... 206/524.8
5,701,996 A * 12/1997 Goto et al. ..... 206/287
6,029,810 A * 2/2000 Chen ..... 206/287
6,059,457 A * 5/2000 Sprehe et al. ..... 383/63
6,076,967 A * 6/2000 Beaudette ..... 383/41
6,085,906 A * 7/2000 Lambert ..... 206/524.8
6,116,781 A * 9/2000 Skeens ..... 383/100

* cited by examiner

*Primary Examiner*—Lee Young
*Assistant Examiner*—Lien M Ngo
(74) *Attorney, Agent, or Firm*—Keating & Bennett, LLP

(57) ABSTRACT

The compression storage bag includes a storage bag main body, which has an entrance-exit portion (or an opening portion) on one side, for putting in and taking out goods to be stored. The opening portion is made open-close free, by open-close means. The compression storage bag has a first non-return valve on the opposite side of the opening portion. This first non-return valve is provided with one side extending to the inside of the storage bag main body, and the other side extending to a path that connects communicatively with the exterior of the storage bag main body. Moreover, the compression storage bag has an outlet, which makes it possible for the air inside the storage bag main body to flow out through the first non-return valve and the path. In particular, a second non-return valve, which has an opening portion through which air is sucked out of the interior of the storage bag main body, is formed at a different place from the first non-return valve.

16 Claims, 12 Drawing Sheets

COMPRESSION STORAGE BAG

BACKGROUND OF THE INVENTION

1. Field of the Invention

The present invention relates to a compression storage bag, and more particularly, the present invention relates to a compression storage bag that can compactly store therein with compression, clothes such as underwear, coats, socks, or bedclothes such as toweling-blankets, blankets, bedding, and floor cushions, or other goods like handkerchiefs, towels, and hats.

2. Description of the Prior Art

Among conventional compression storage bags, some compression storage bags are constructed for storing large sized goods such as bedding, floor cushions and heavy clothes, which are stored under compression by using, for example, a vacuum cleaner. Recently, various storing devices using compression-storage bags have come to be utilized more frequently because of the reduction in storage space that is available.

In this type of conventional storing method that uses compression storage bags, suction equipment such as a vacuum cleaner is required, and no particular difficulty was presented in doing the compression-storage work in ordinary households that have a vacuum cleaner. However, in situations where a vacuum cleaner is not available, or when doing the compression-storage work using the compression storage bag while traveling, it is inconvenient since it is not easy to carry a vacuum cleaner around. On the other hand, there is a demand for a compression-storage bag with an easy compression-storage operation that does not require the use of suction equipment such as a vacuum cleaner.

SUMMARY OF THE INVENTION

In order to overcome the problems described above, preferred embodiments of the present invention provide a compression storage bag, in which suction equipment such as a vacuum cleaner can be used, or in some cases, the compression-storing operation can be done manually without using suction equipment, as appropriate, depending on the kind and number of the goods to be stored, and depending on the circumstances of the compression-storing operation.

The compression storage bag according to a preferred embodiment of the present invention includes a storage bag main body having an entrance-exit portion on one side for putting in and taking out goods to be stored, a first non-return valve arranged with one side extending into an inside of the storage bag main body and the other side extending to a path connecting communicatively to an exterior of the storage bag main body, an outlet that is arranged and installed on an end edge of the storage bag main body on the opposite side of the entrance-exit portion and which makes it possible for air inside the storage bag main body to flow out through the first non-return valve and the path, and open-close device that allows the entrance-exit portion to be easily opened and closed.

Moreover, the compression storage bag according to a preferred embodiment of the present invention preferably includes a second non-return valve that is arranged at a different location than the first non-return valve, and has an opening portion that sucks air out of the interior of the storage bag main body.

In the compression storage bag described above, the second non-return valve may include an inner valve portion extending to the interior of the storage bag main body, and an outer valve portion connected communicatively to the inner valve portion and extending out to the exterior of the storage bag main body.

In each of the compression storage bags described above, the storage bag main body may have a first non-return valve group that includes a plurality of the first non-return valves arranged and installed at intervals so as to be spaced from each other.

Furthermore, in each of the compression storage bags described above, the second non-return valve may include a blocking fastener that blocks the airflow between the storage bag main body and the exterior, and the blocking fastener may be equipped with a first belt, a hook claw that extends in the longitudinal direction of the first belt, a second belt, and another hook claw that is arranged to extend in the longitudinal direction of the second belt, and which is fitted with the hook claw of the first belt. Moreover, the first belt and the second belt may have a flat annular form, with both of the mutually opposing sides in the longitudinal direction fixed together, and the fixed portion may be fixed to a radial end portion of the outer valve portion.

Furthermore, in the compression storage bag described above, the blocking fastener may include a plurality of female hook claws which extend in the longitudinal direction of the first belt and which are arranged along a width direction of the first belt at intervals from each other, and a plurality of male hook claws which extend in the longitudinal direction of the second belt, and which are arranged along a width direction of the second belt at intervals from each other. The plurality of female hook claws and the plurality of male hook claws may be fitted with each other.

Furthermore, in the compression storage bag described above, a hanging device that hangs and supports the storage bag main body at a desirable location may also be included. Moreover, the hanging device may include a support member that is arranged and installed detachably on the opposite side of the entrance-exit portion of the storage bag main body, and which supports the storage bag main body, and a swiveling hook member that is arranged and installed to the support member detachably.

In the compression storage bag described above, it is effective if the support member is able to be freely opened and closed, and if the support member includes a pair of sandwiching plates that sandwich the end portion of the storage bag main body on the opposite side of the entrance-exit portion, a fitting portion that is arranged and installed on the longitudinally central portion of the pair of sandwiching plates, and which has a latching hole extending therethrough, and into which the hook member is detachably connected, and a clamping member with which a space between one sandwiching plate and the other sandwiching plate is clamped, when the storage bag main body is sandwiched between the pair of sandwiching plates.

Furthermore, in the compression storage bag described above, it is effective if the clamping member includes a plurality of button portions that are arranged and installed in the longitudinal direction on one of the sandwiching plates at predetermined intervals, and which have spherical sector elastic portions, a plurality of buttonhole portions that are arranged and installed in the longitudinal direction on the other sandwiching plate at predetermined intervals, and to which the button portions are secured. With this structure, the button portion may have flat-planes on both sides in a radial direction, and the buttonhole portion may have an arc form portion, and a straight-line portion corresponding to the flat-plane at a circumferential edge thereof. It is effective also if the width between the straight-line portions on the buttonhole portion is slightly smaller than that of the elastic portion.

Furthermore, in the compression storage bag described above, the hook member may have an annular frame base piece, a latching piece having a latching hole which is arranged and installed opposing the base piece and latched to the fitting portion, a hook neck-piece that extends from the base piece in a direction opposite to a direction in which the latching piece extends, and a hook body that is arranged and installed to be swivel-free through a hinge portion formed on the end edge portion of the hook neck-piece. Moreover, the latching piece may have an elastic force that resists against the force that acts in the direction moving away from the base piece.

Furthermore, in the compression storage bag described above, it is preferred that the latching piece includes a projecting member that expands or protrudes to one side of the latching piece and which is fitted to the latching hole of the fitting portion, a thin-wall guide portion that is arranged and installed on a portion of the projecting member and which is provided to make it easier for the front tip of the latching piece to fit along the surface of the fitting portion, a convex shaped fall-out prevention piece that is latched to the edge of the latching hole, when the projecting member is fitted to the latching hole of the support member.

In the compression storage bag according to various preferred embodiments of the present invention, goods to be stored such as clothes are put inside the storage bag main body through the entrance-exit portion, and the entrance-exit portion is closed by the open-close member, when necessary. Then, when putting the goods to be stored inside the storage bag main body, and compression-storing without using suction equipment such as a vacuum cleaner, the air inside the storage bag main body is pushed out by pressing down on the bag from the exterior. Air inside the storage bag main body is emitted from the outlet, through the first non-return valve and then the path. As a result, the interior of the storage bag main body enters into a negative pressure state, and the goods to be stored inside the storage bag main body along with the storage bag main body are compressed to a flat form. The inflow of ambient air from the outside into the storage bag main body is prevented, by the non-return action of the first non-return valve. In this case, there is no need to use the second non-return valve.

On the other hand, when compression-storing the goods to be stored using suction equipment such as a vacuum cleaner, the second non-return valve is used. The inner valve portion and the outer valve portion of the second non-return valve becomes an airflow path that lets air flow between the interior and exterior of the storage bag main body. A nozzle of a vacuum cleaner, for example, is inserted into the opening portion on the outer valve portion of the second non-return valve. Air inside the storage bag main body is removed via suction through the opening portion of the outer valve portion, and the interior of the storage bag main body is caused to be in a negative pressure state. At this moment, a force pressing the outside surface of the inner valve portion is generated, and the inner sides of the inner valve portion are closely adhered to each other. Furthermore, the opening portion on the outer valve portion is blocked by fitting the hook claw on the first belt-form portion of the blocking fastener with the hook claw on the second belt-form portion of the blocking fastener. As a result, the airflow between the inner side and outer side of the storage bag main body is cut off.

In a compression storage bag including the first non-return valve, air inside the storage bag main body is emitted more effectively through the plurality of first non-return valves and the path, during the compression-storing operation.

Furthermore, in a compression storage bag including the hanging device, a flat-formed compression storage bag that has been compression-stored by hand or by using suction equipment such as a vacuum cleaner, is hanged and supported in a desirable place using the hanging device. In this case, the compression storage bag is capable of being stored in a vertically upright orientation, if desirable. As a result, when using the compression storage bag according to preferred embodiments of the present invention, planar storage space can be reduced, compared to the conventional storing in stacks.

In a compression storage bag having the hanging device including a support member and a hook member, the support member supports the storage bag main body, and the storage bag main body is hanged in a desirable place with the hook member. The hook member is able to freely swivel, so the angle of the swivel can be adjusted appropriately according to the hanging location. The hook member and the support member can be separated, so they can be managed separately.

In a compression storage bag with a support member that includes a pair of sandwiching plates, a fitting portion, and the clamping member, the hook member is sandwiched between the fitting portion. A prescribed portion of the storage bag main body is sandwiched between the pair of sandwiching plates, and is clamped with and fixed by the clamping member.

In a compression storage bag with the clamping member that includes a button portion and a buttonhole portion, the button portion of the clamping member is secured to the buttonhole portion. The flat plane of the button portion is guided to the straight-line portion of the buttonhole portion, and the elastic portion of the button portion is guided and inserted through the arc form portion of the buttonhole portion. In this case, when the elastic portion passes through the buttonhole portion, it pushes open the circumferential edge of the buttonhole portion temporarily, because of the elasticity. But the buttonhole portion returns to the original position after passing, and thus the elastic portion is latched and secured to the buttonhole portion.

In a compression storage bag with a hook member that includes a base piece and a latching piece and a hook body, the fitting portion of the above-mentioned support member is sandwiched between the base piece and the latching piece. When sandwiching the fitting portion between the base piece and the latching piece, the base piece and the latching piece are separated from each other temporarily, because of the force of the latching piece. However, they return to the original position after the fitting portion is sandwiched. The hook body is capable of swiveling by the action of the hinge portion.

In a compression storage bag with a latching piece that includes a projecting member, a thin-wall guide portion and a fall-out prevention piece, the projecting member of the latching piece is inserted through and latched to the latching hole in the fitting portion of above-mentioned support member. Since a thin-wall guide portion is provided at the front tip of the latching piece, the latching piece is initially easy to fit along the surface of the mating portion. In other words, the thin-wall guide portion functions as a guide, when the latching piece is fitted to the fitting portion of the support member. Moreover, when the projecting member is fitted to the latching hole of the support member, the fall-out prevention piece is latched to the edge end of the latching hole, and a fall-out prevention effect becomes active.

The above-mentioned and other elements, characteristics, features and advantages of the present invention, will become more apparent from the following detailed description of preferred embodiments, taken in connection with the drawings.

DETAILED DESCRIPTION OF PREFERRED EMBODIMENTS

Figure 1:
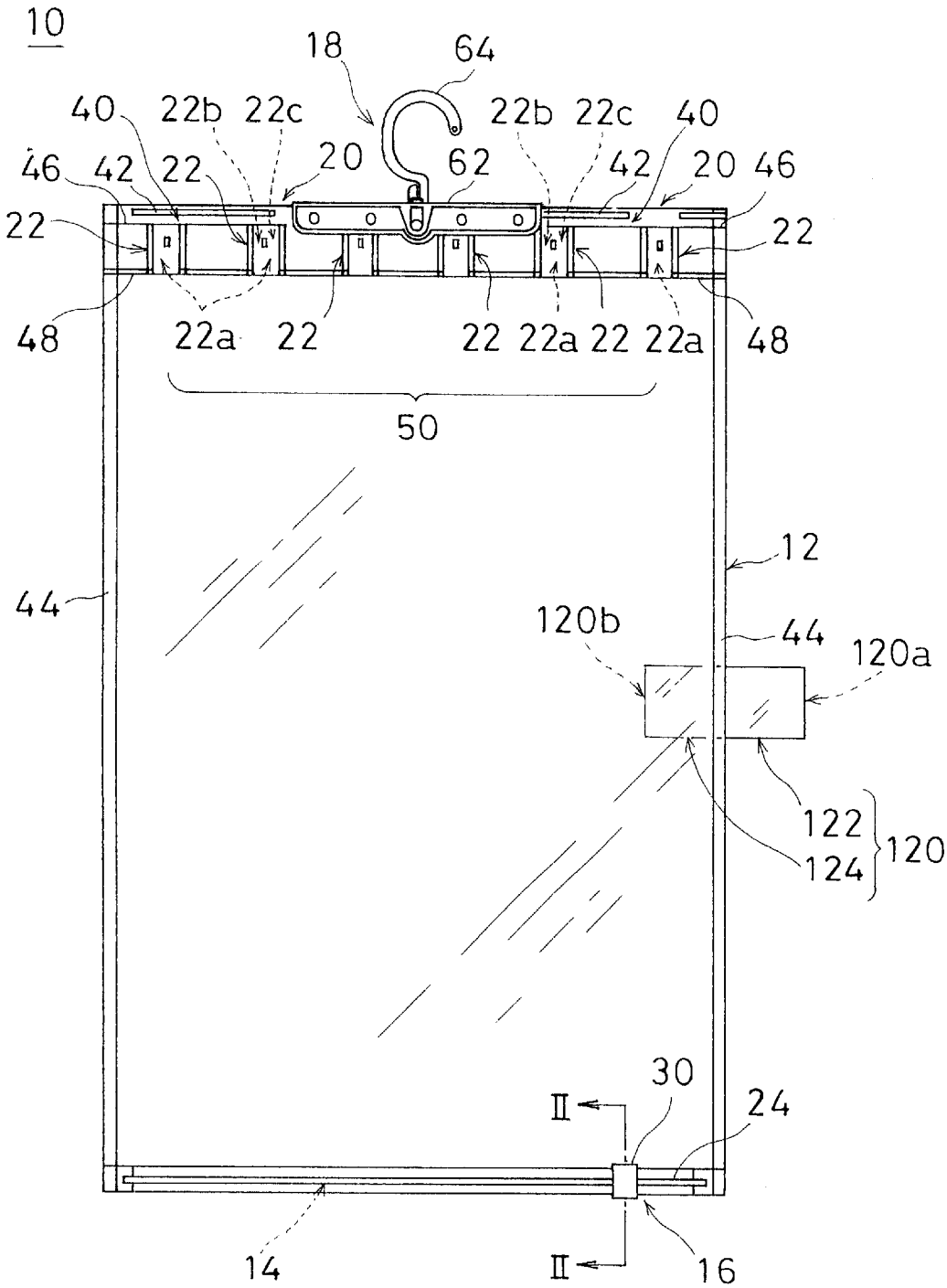
FIG. 1 is a front view of an example of a compression storage bag according to a preferred embodiment of the present invention.
Figure 2:
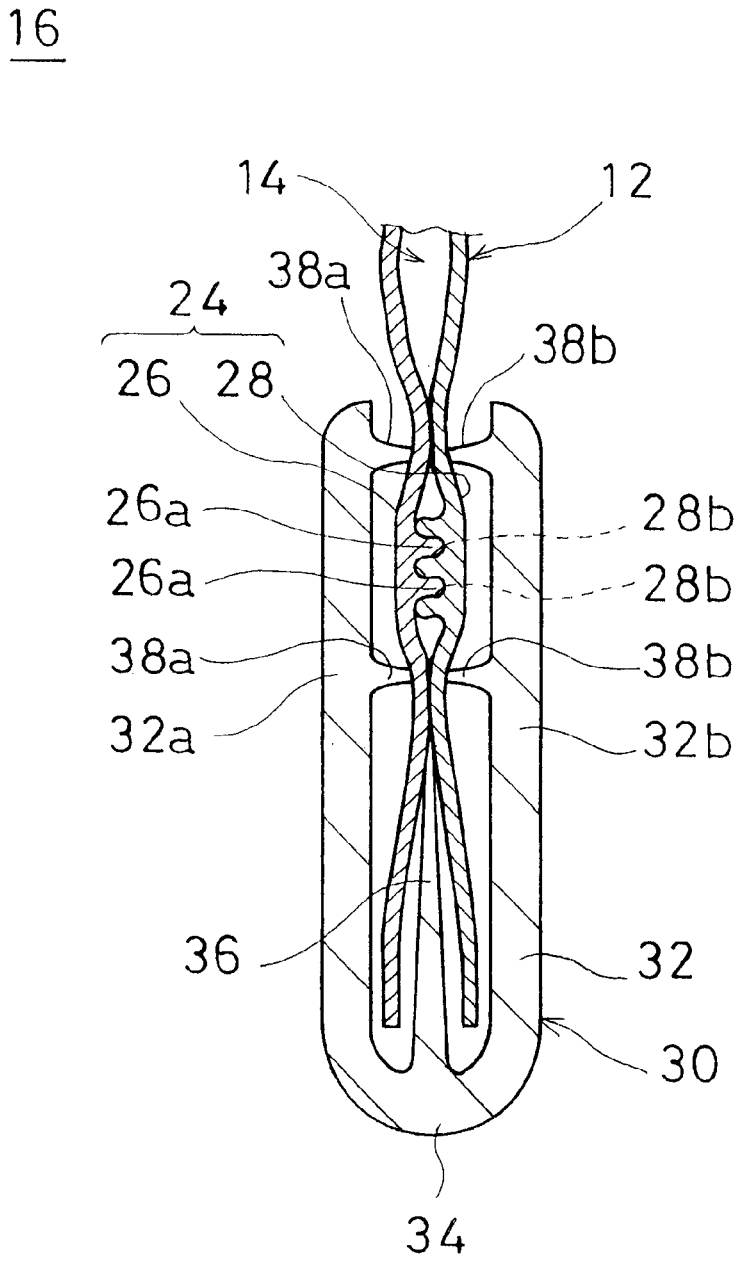
FIG. 2 is a sectional view taken along the II—II line of FIG. 1.

FIG. 1 is a perspective view of an example of a compression storage bag according to a preferred embodiment of the present invention. The compression storage bag 10 in this preferred embodiment preferably includes a storage bag main body 12, an open-close device 16 that opens and closes an entrance-exit portion 14 (or opening portion) of the storage bag main body 12 freely, a hanging device 18 that supports the storage bag main body 12 by hanging it, an outlet 20 for allowing air to flow from inside the storage bag main body 12 out to the exterior; a plurality of first non-return valves 22 that prevent air from flowing into the storage bag main body 12 from the exterior, a second non-return valve 120 that has an opening portion for sucking air out from the storage bag main body 12.

It should be noted that, with the compression storage bag 10 according to this preferred embodiment, it is possible after compressing to make use of the hanging device 18 to hang and store the storage bag main body 12 wherever desirable, thereby reducing the required storage space.

The construction, operation and advantages of the compression storage bag 10 will be described in detail below. For example, the compression storage bag 10 includes the storage bag main body 12, which is preferably substantially rectangular shaped. The storage bag main body 12 is preferably made of non-permeable laminated films such as those made of synthetic resin material. The storage bag main body 12 has the opening portion 14 on one side end in the vertical direction. The opening portion 14 functions as the entrance and exit portion, when putting in and taking out goods to be stored such as clothes, etc. The opening portion 14 can be closed by the open-close device 16, as desirable.

The open-close device 16 preferably includes a pair of open-close fasteners 24 made of, for example, synthetic resin, and a clamp 30 that supports the closing of the open-close fastener 24. The open-close fastener 24 has, for example, a belt-type male half-member 26 extending crosswise relative to the storage bag main body 12, and a female half-member 28 that is engaged with the male half-member 26. The male half-member 26 is equipped, for example, with two convex portions 26*a*, and the female half-member 28 is equipped with two concave portions 28*b* that are engaged with the convex portions 26*a*.

The clamp 30 includes, for example, a clamp main body 32 having a substantially U-shaped section. A separator tongue piece 36 with a substantially triangular section and a substantially rectangular shaped top view, for example, is provided to extend from a connecting portion 34 of the clamp main body 32, in the direction extending between two opposing pieces 32*a* and 32*b* that oppose to each other. Moreover, on the opposing inside surfaces of one opposing piece 32*a* and the other opposing piece 32*b*, two claw pieces 38*a* are arranged with a prescribed longitudinal interval therebetween. The two claw pieces 38*a* are arranged to extend from one end portion in the width direction of one opposing piece 32*a*, to the other end portion. Similarly, two claw pieces 38*b* are arranged on the opposite portion of the two claw pieces 38*a*.

When the clamp 30 is fixed to the open-close fastener 24, the separator tongue piece 36 is inserted between the male half-member 26 and the female half-member 28 of the open-close fastener 24, and the convex portions 26*a* and the concave portions 28*b* of the open-close fastener 24 are arranged in the area surrounded by the two opposing claw pieces 38*a* and 38*b*. When the clamp 30 is slid in the longitudinal direction of the open-close fastener 24, the opposing claw pieces 38*a* and 38*b* presses the male half-member 26 and the female half-member 28, and facilitates the engagement of the convex portions 26*a* and the concave portions 28*b*. As a result, the closing operation of the open-close fastener 24 is performed more easily, and with reliability.

Moreover, the storage bag main body 12 preferably has an outlet 20 that is connected to the ambient air outside the storage bag main body 12, on the other vertical side end that is opposite to the entrance-exit portion. On an opening end edge 15 on the opposite side of the entrance-exit portion of the storage bag main body 12, a plurality of outlets 20 are arranged at predetermined intervals. The portion of the opening end edge 15 of the storage bag main body 12 excluding the plurality of outlets 20, is fixed by fusion portions 42 formed by fusion methods or other suitable methods, and sealed tightly. The outlet 20 allows air to flow out of the storage bag main body 12.

A path 40 that connects communicatively with the exterior of the storage bag main body 12 through the plurality of outlets 20, is arranged on the other vertical end of the storage bag main body 12. This path 40 is arranged in the portion surrounded by fusion portions 44 on both of the horizontal ends, the opening end edge 15 including the above mentioned fusion portions 42, and fusion portions 46. The fusion portions 44 are formed by fusion methods or other suitable methods, during the manufacturing of the storage bag main body 12. The fusion portions 46 are preferably arranged with a predetermined vertical interval from the opening end edge 15 of the storage bag main body 12, and extend with a predetermined horizontal interval. In this preferred embodiment, the path 40 is preferably arranged to define a laterally elongated substantially rectangular member as viewed from the front view in FIG. 1, and also in flat form.

Furthermore, a first non-return valve group 50, which includes a plurality of the first non-return valves 22 located below the path 40 with a predetermined horizontal interval, is arranged on the storage bag main body 12.

Figure 3:
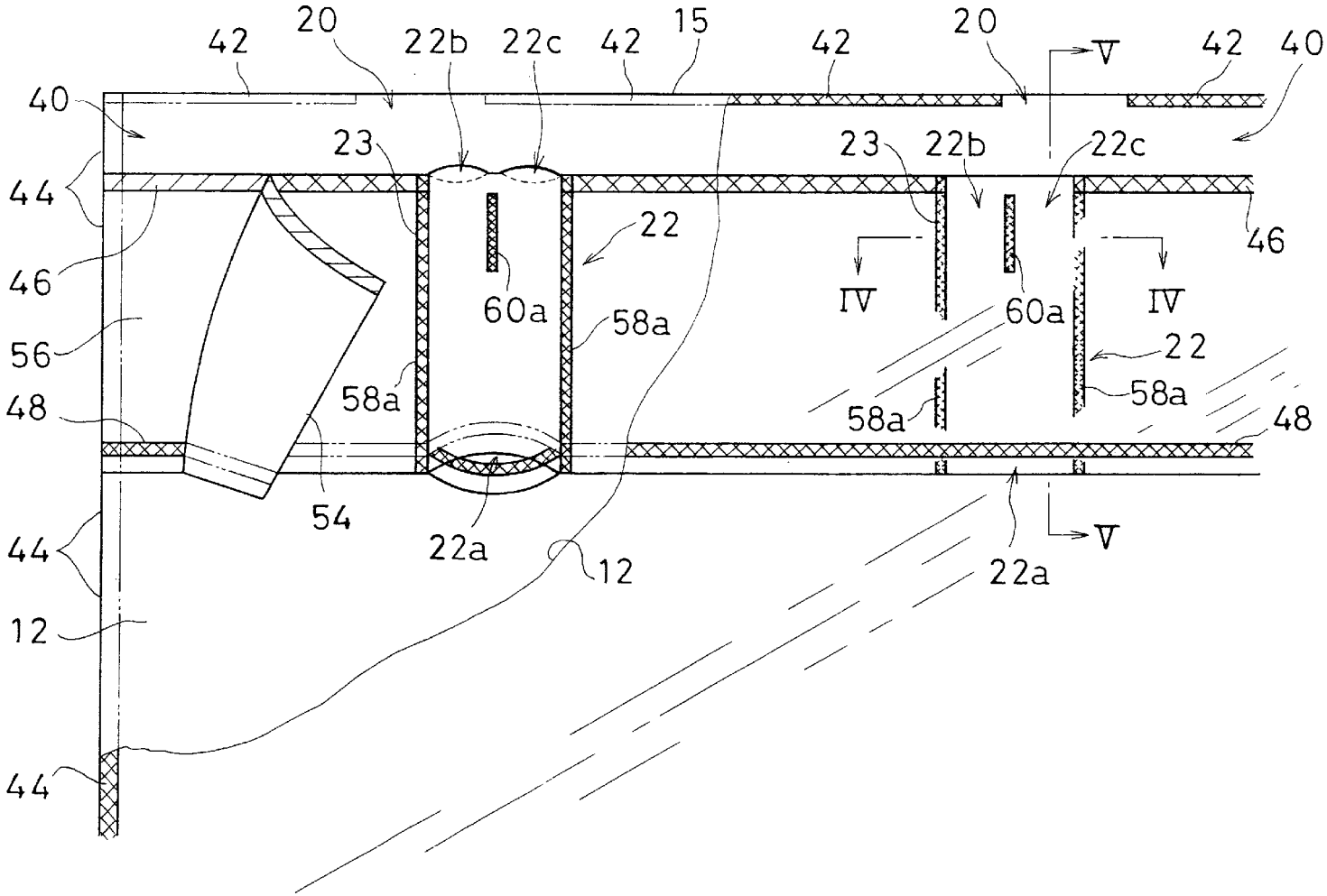
FIG. 3 is an enlarged front view of the principal portion of a non-return valve included in the compression storage bag of a preferred embodiment of the present invention, showing the arrangement thereof.
Figure 4:
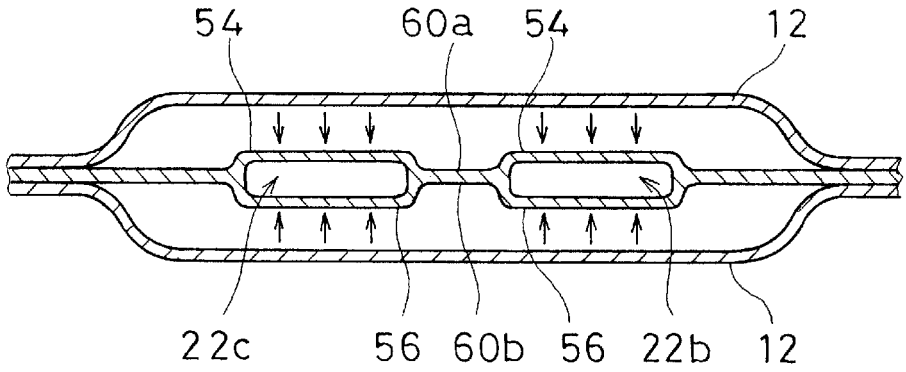
FIG. 4 is an enlarged sectional view of the principal portion, taken along the IV—IV line of FIG. 3.
Figure 5:
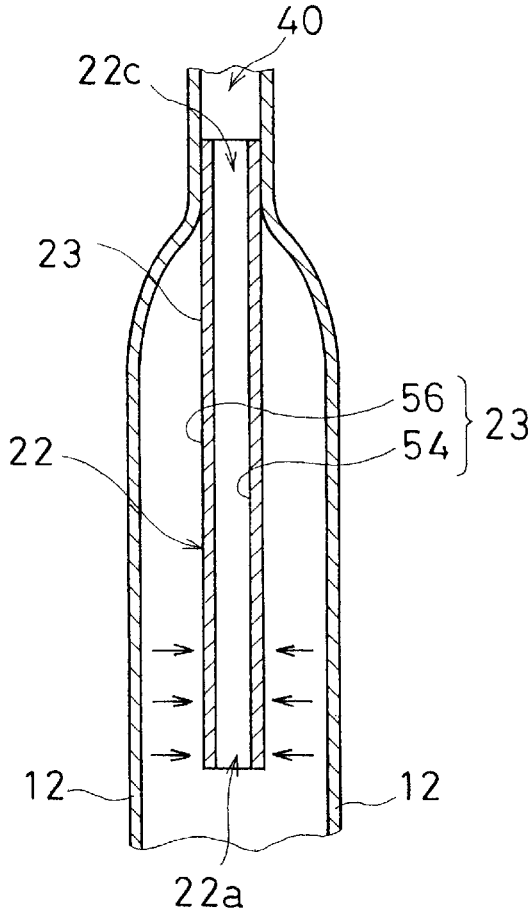
FIG. 5 is an enlarged sectional view of the principal portion, taken along the V—V line of FIG. 3.
Figure 6:
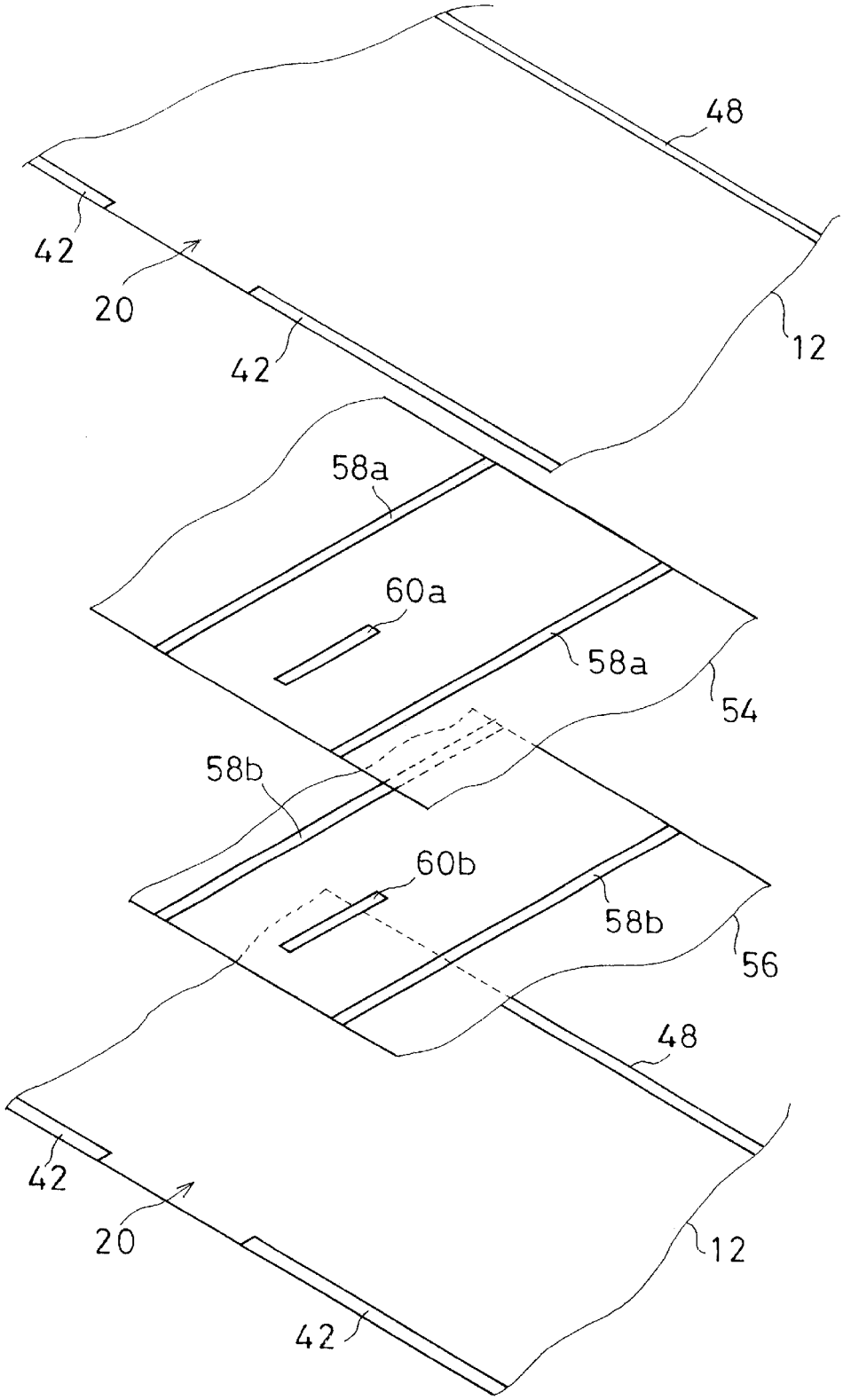
FIG. 6 is an enlarged exploded perspective view of the principal portion of a first non-return valve included in the compression storage bag of a preferred embodiment of the present invention.

As shown in FIGS. 3 and 5, the first non-return valve group 50 has a plurality of flat tubular shaped portions 23 made, for example, of synthetic resin material, that forms the main body of the valve. As shown in FIG. 6, for example, each of the flat tubular shaped portions 23 is preferably formed by superimposing valve base pieces 54 and 56, and fusing the pieces together. The valve base pieces 54 and 56 are preferably elongated substantially rectangular-belt shaped, and made of non-permeable synthetic resin film.

That is, as is particularly illustrated in FIG. 6, the valve base pieces 54 on one side, and the valve base pieces 56 on the other side constitute the plurality of flat tubular shaped portions 23, by mutually fusing together the fusing portions 58*a* and 58*b*. The fusing portions 58*a* and 58*b* are arranged and installed at predetermined longitudinal intervals. Furthermore, fusing portions 60*a* and 60*b*, which are arranged and installed for a predetermined length in the vertical direction between the fusing portions 58*a* of the valve base piece 54, and between the fusing portions 58*b* of the valve base piece 56, are mutually fused together. Then, as in FIG. 3, the vertically bottom end portion of the valve base pieces 54 and 56 are fixed to the storage bag main body 12, at fusing portions 48.

As particularly described in FIG. 6, the top surface of the valve base piece 54 and the bottom surface of the valve base piece 56 are each fixed to the inner side surface of the storage bag main body 12. As a result, the first non-return valve group 50 having the plurality of first non-return valves 22 is arranged and installed at a predetermined position inside the storage bag main body 12. In this case, the first non-return valve 22 has one opening portion 22*a* on one end in the axial direction, and has opening portions 22*b* and 22*c* separated by the fusing portions 60*a* and 60*b*, on the other end of the axial direction. On one side of the first non-return valve 22, the opening portion 22*a* is arranged so as to face the interior of the storage bag main body 12, and openings 22*b* and 22*c* on the other side of the first non-return valve 22 are arranged so as to face the path 40.

The first non-return valve 22 described in this preferred embodiment is just one example, and it is not limited to those particularly described in FIGS. 1, 3, 4, 5, and 6. The valve structure of the first non-return valve 22 can be changed if necessary, so long as it has a non-return valve function. It should be noted that, a first non-return valve can be selected and used from among those with valve structures disclosed in, for example, Utility Model Laid-Open Publication No. Hei. 5-26886, Utility Model Registration No. 3003479, Utility Model Laid-Open Publication No. Hei. 6-3846, Utility Model Laid-Open Publication No. Hei. 5-6265, Utility Model Laid-Open Publication No. Hei. 5-42147, U.S. Pat. No. 5,540,500, and U.S. Pat. No. 4,674,532, and others.

Figure 7:
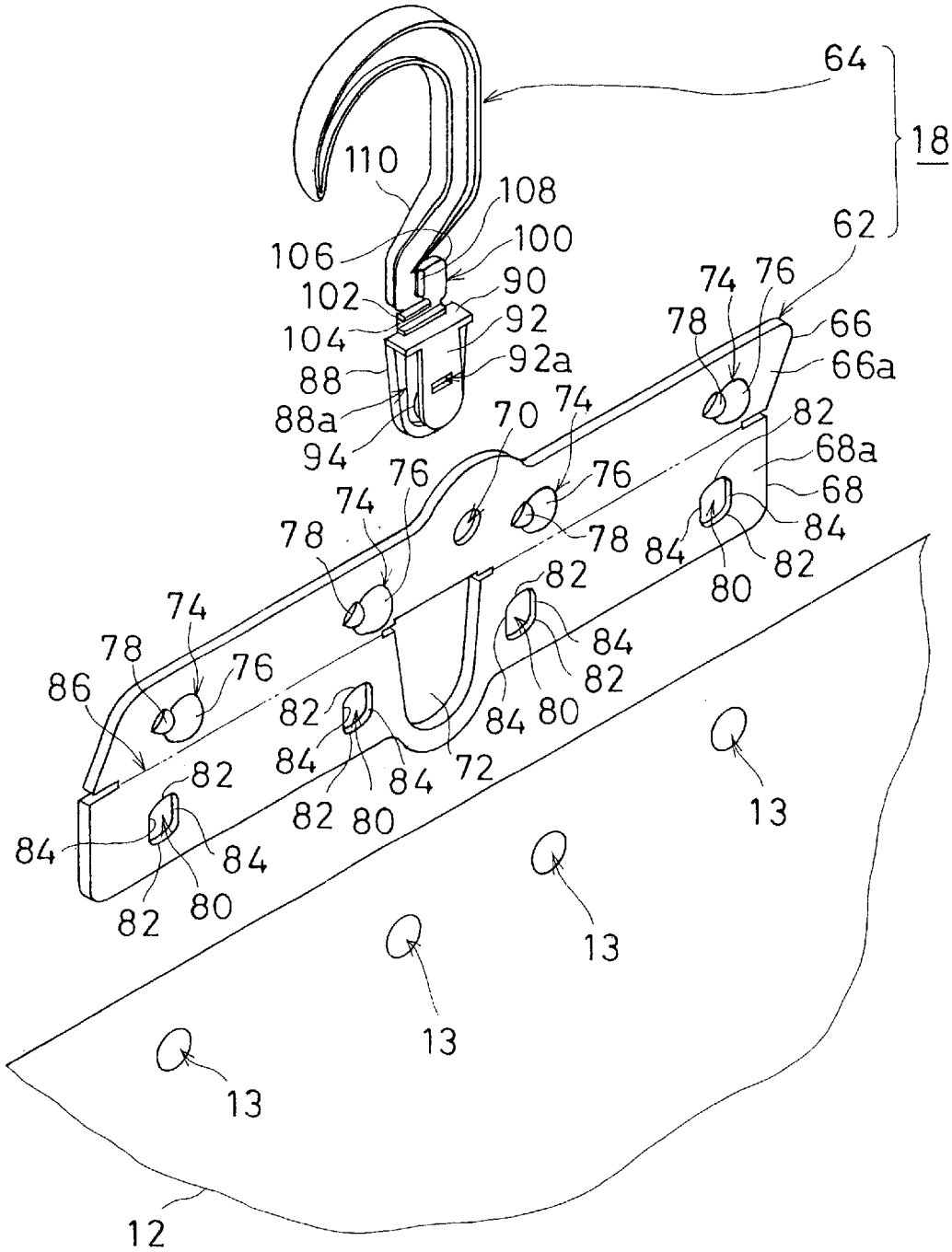
FIG. 7 is a perspective view of the principal portion, showing one example of hanging device included in the compression storage bag of a preferred embodiment of the present invention.

In the compression storage bag 10 of this preferred embodiment, the hanging device 18 that can hang and support the storage bag main body 12 at a desirable place, is preferably provided. That is, in the present preferred embodiment, as shown in FIGS. 1 and 7 and other figures, the hanging device 18 is arranged and installed detachably, at the crosswise central position on the side end portion of the storage bag main body 12, opposite to the entrance-exit portion 14. The hanging device 18 has a support member 62 that supports the storage bag main body 12, and a hook member 64 that can swivel around and is mounted to the support member 62 detachably.

The support member 62 preferably includes a pair of sandwiching plates 66 and 68 that are arranged to freely opened and closed. One sandwiching plate 66 and the other sandwiching plate 68 include plate main bodies 66*a* and 68*a*, respectively. One of the plate main bodies 66*a* preferably has, for example, a latching hole 70 including a substantially circular piercing hole on the longitudinally central portion thereof. The other plate main body 68*a* preferably has a fitting portion 72 including a concave portion with a substantially U-shaped front view in FIGS. 1 and 7, on the longitudinally central portion. The fitting portion 72 is arranged between one sandwiching plate 66 and the other sandwiching plate 68.

As shown in FIG. 7, the pair of sandwiching plates 66 and 68 sandwiches the end portion of the storage bag main body 12, and the pair of sandwiching plates 66 and 68 are clamped with a clamping device, which will be described later. Furthermore, a latching piece 92 of the hook member 64 is mounted detachably to the fitting portion 72, between the pair of sandwiching plates 66 and 68. The hook member 64 will be described in detail later.

A plurality of button portions 74 are arranged at predetermined longitudinal intervals along one of the plate main bodies 66*a*. The button portion 74 includes, for example, a substantially spherical sector elastic portion 76. A rectangular flat-planar member 78, for example, is provided on both of the radial sides of the elastic portion 76. The flat-plane 78 is arranged to extend in a substantially direction relative to the length of the plate main body 66*a*.

Moreover, the other plate main body 68*a* has a plurality of buttonhole portions 80 arranged at predetermined longitudinal intervals. The buttonhole portions 80 are arranged at positions corresponding to the button portions 74 described above, and are arranged to secure the button portions 74. The circumferential edge of the buttonhole portion 80 includes an arc form portion 82, and a straight-line form portion 84, to which the flat-plane 78 of the button portions 74 is secured. A curb-line form portion on the elastic portion 76 of the button portions 74 is secured to the arc form portion 82. The width between the straight-line form portions 84, as can be seen in FIG. 7, is slightly smaller than the lateral width of the elastic portion 76 of the button portions 74.

In this preferred embodiment, the plate main body 66*a* and the elastic portion 76, the plate main body 68*a* and the fitting portion 72, are both formed unitarily of, for example, an elastic synthetic resin material. Moreover, one of the sandwiching plates 66 and the other sandwiching plate 68 are arranged to be freely opened and closed by a hinge portion 86, as shown in FIG. 7. The hinge portion 86 is preferably a tape-hinge including a narrow-width belt made of, for example, an elastic synthetic resin material.

It should be noted that, a plurality of mounting holes 13 are preferably arranged and installed at the end portion of the storage bag main body 12, in the lateral direction at predetermined intervals. These mounting holes 13 are arranged at positions corresponding to the respective button portions 74 and the buttonhole portions 80. The support member 62 of the hanging device 18 is mounted to the storage bag main body 12 detachably, by having the button portions 74 inserted through the mounting holes 13, and also by being latched to the buttonhole portion 80.

In this preferred embodiment, the button portions 74 and the buttonhole portions 80 of the support member 62 function as the clamping device to clamp the pair of sandwiching plates 66 and 68 therewith.

Figure 8:
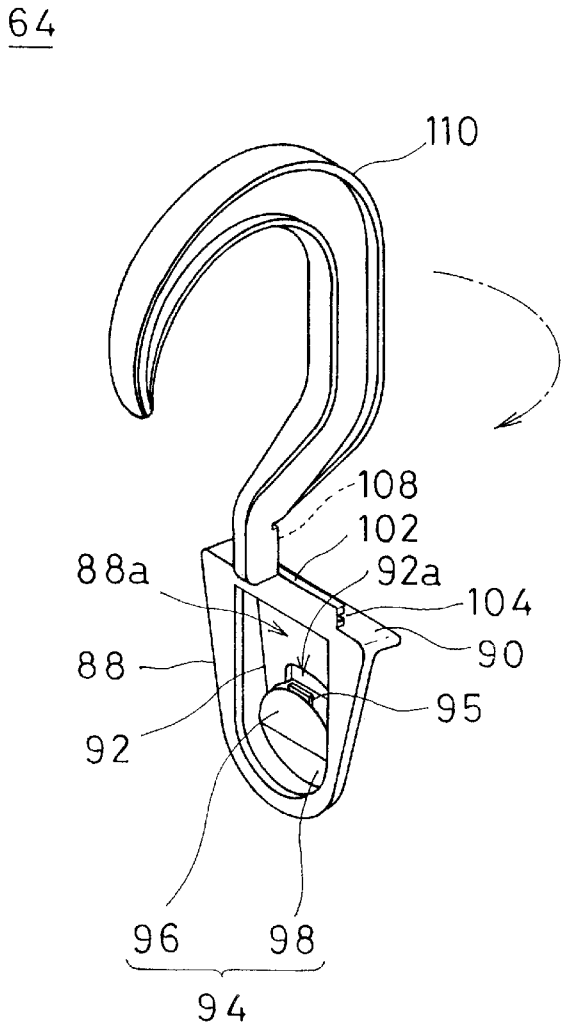
FIG. 8 is a perspective view, showing an example of a hook member included in the compression storage bag of a preferred embodiment of the present invention.

The hook member 64 will be described next, with references to FIGS. 7 and 8. The hook member 64 preferably includes, for example, a base piece 88 having a substantially U-shaped and annular frame configuration. A substantially rectangular support piece 90 is provided on the top end edge portion of the base piece 88, extending horizontally from the edge thereof. At the longitudinally central portion of the support piece 90, a substantially U-shaped latching piece 92, for example, is provided. The latching piece 92 extends downward in a substantially perpendicular direction from the edge portion of an end of the support piece 90. The latching piece 92 also extends in line and in the same direction with the base piece 88, and its outer dimension is preferably smaller than the outer dimension of the internal circumferential edge of the opening portion 88*a* of the base piece 88.

A projecting member 94 is disposed on the front-end side of one of the principle surfaces, on the latching piece 92. The projecting member 94 has, for example, a convex portion 96 that is substantially semicircular in section. The convex portion 96 is arranged to protrude in an expanded condition, to face the opening portion 88*a* of the base piece 88. The projecting member 94 is connected to the convex portion 96, and has a thin-wall guide portion 98 that has a relative thin wall portion facing the front-end side of the latching piece 92. On the top end of the convex portion 96, for example, a substantially rectangular convex shaped fall-out prevention piece 95 is provided as a protruding piece. It should be noted that, the latching piece 92 has a hole 92*a* extending from one principle surface to the other principle surface, near the projecting member 94.

In this preferred embodiment, the base piece 88, the support piece 90, the latching piece 92, the projecting member 94, the protruding piece 95, the convex portion 96, and the thin-wall guide portion 98, are all preferably formed unitarily of elastic synthetic resin material. In this case, the latching piece 92 in particular, provides an elastic force that acts against the force in the direction moving away from the base piece 88.

A hook neck-piece 100 is provided on the top end portion of the base piece 88, in a direction that is opposite to the extending direction of the latching piece 92. The hook neck-piece 100 preferably includes a neck-base piece 102, which has a clinched groove 104 including a linear shaped thin wall portion. On the top edge portion of the neck-base piece 102, a flap piece 106 is provided on one side in the longitudinal direction. A hook body 110, which can swivel with the hinge portion 108, is disposed on the edge of one end of the flap piece 106 in the width direction. The hinge portion 108 is produced preferably by forming a clinched groove that includes a linear shaped thin-wall portion at the appropriate position.

In this preferred embodiment, the predetermined portion at the edge end portion of the storage bag main body 12 at the opposite side of the entrance-exit portion is sandwiched between the sandwiching plates 66 and 68, and is clamped with the clamping device such as the button portions 74 and the buttonhole portions 80, or other suitable clamping devices. When securing the button portions 74 to the buttonhole portions 80, the button portions 74 are inserted through the buttonhole portions 80 and secured, by having the flat-plane 78 of the button portions 74 guided to the straight-line form portions 84 of the buttonhole portions 80, and also by having the elastic portion 76 of the button portions 74 guided to the arc form portion 82 of the buttonhole portions 80. In this case, the elastic portion 76 pushes open with the elastic force, the circumferential edge of the buttonhole portion 80 temporarily, when passing through the buttonhole portion 80. After passing through, the condition returns to the original state, and the elastic portion 76 of the button portion 74 is secured to the buttonhole portion 80.

Furthermore, in this preferred embodiment, the hook member 64 is mounted detachably to the fitting portion 72 of the sandwiching plates 66 and 68. The latching piece 92 of the hook member 64 is latched to the fitting portion 72 of one of the sandwiching plates 66. The fitting portion 72 of the support member 62 is sandwiched between the base piece 88 and latching piece 92 of the hook member 64. When sandwiching the fitting portion 72 between the base piece 88 and latching piece 92, the base piece 88 and latching piece 92 separate from each other temporarily, because of the momentum gaining force of the latching piece 92. Then, the projecting member 94 of the latching piece 92 is inserted through the latching hole 70 of the fitting portion 72, and is latched.

In this case, the latching piece 92 is inserted through the latching hole 70, by having its front end portion slid along the surface of the fitting portion 72 of the thin-wall guide portion 98. In other words, the thin-wall guide portion 98 functions as a guide, when the latching piece 92 is initially fitted to the fitting portion 72. When the projecting member 94 is latched to the latching hole 70, and the latching piece 92 is mounted to the fitting portion 72 of the support member 62, the base piece 88 and the latching piece 92 returns to the original state. Hence, the fitting portion 72 is sandwiched between the base piece 88 and the latching piece 92 even more, by the elastic force of the base piece 88 and the latching piece 92.

Moreover, when the projecting member 94 is fitted into the latching hole 70 of the support member 62, the fall-out prevention piece 95 is latched on the edge end of the latching hole 70, and the hook member 64 is mounted even more securely to the fitting portion 72.

In the compression storage bag 10 of this preferred embodiment, the opening portion 14 is shut by having the goods to be stored such as clothes placed inside the storage bag main body 12, and shutting the open-close fastener 24 with the clamp 30. In this case, the goods to be stored are stored in a hermetically sealed state, because the interior of the storage bag main body 12 is connected communicatively to the ambient air only in the direction that the air inside the storage bag main body 12 flows outside through the non-return valves 22 and path 40.

Then, in this condition, the entire bag main body 12 is pressed from the exterior, by pressing down on the packaging goods. At this moment, the air inside the storage bag main body 12 is emitted to the exterior, through the openings 22*a*, 22*b*, and 22*c* in each first non-return valve 22 of the first non-return valve group 50, and through the path 40, and through the plurality of outlets 20.

As a result, the goods to be stored along with the storage bag main body 12 are compressed to a flat form, and the stored goods are hermetically sealed inside the storage bag main body 12. In this case, since the interior of the storage bag main body 12 is decompressed compared to the exterior to a so-called negative pressure state, the inside surfaces of the non-return valve 22 are closely adhered, and the openings 22*a*, 22*b*, and 22*c* are blocked. That is, after storing by compression, the inflow of ambient air from the exterior into the storage bag main body 12 is prevented through the action of each first non-return valve 22 in the first non-return valve group 50.

Moreover, in this preferred embodiment, the pluralities of non-return valves 22 are not exposed directly to the exterior, because one axial end portion and the other axial end portion of the plurality of non-return valves 22 are each arranged inside the storage bag main body 12 and the path 40. As a result, there is no fear of the plurality of non-return valves 22 being damaged when in contact with other things, and the non-return effect is achieved even more effectively.

In the compression storage bag 10 of this preferred embodiment, particularly since the hanging device 18 is arranged and installed, the storage bag main body 12 can be stored by hanging it at a desired location, after compression-storing the goods to be stored. In this case, the compression storage bag 10 can be supported by hanging it in a vertically upright condition.

Consequently, in the compression storage bag 10 of this preferred embodiment, the planar storage space can be reduced, compared to storing in stacks after compression-storing, as in conventional compression storage bags. As a result, in the compression storage bag 10 of this preferred embodiment, the work required to store the compression storage bag, after it has been compression-stored, into closets and other areas has been made easy, and the applicable range of storage areas has been broadened.

Figure 9:
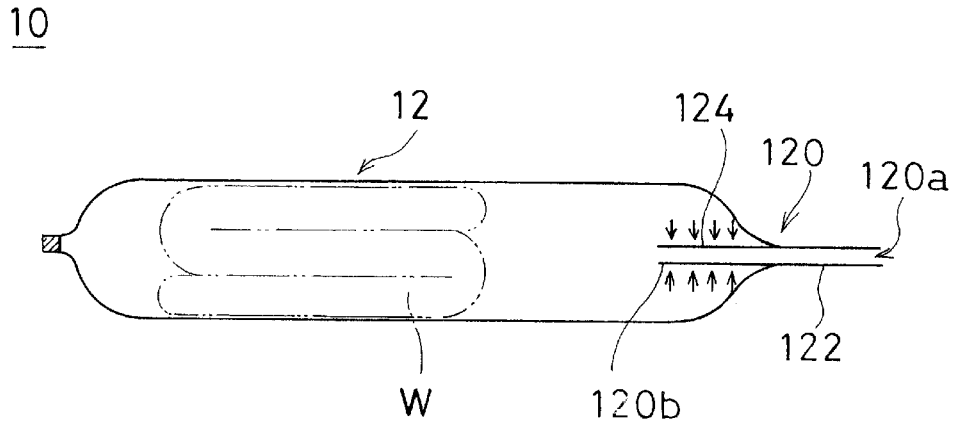
FIG. 9 is an illustrated view of the principal elements, showing one example and the action of a second non-return valve included in the compression storage bag of a preferred embodiment of the present invention.

FIG. 9 is an illustrated view of principal elements, showing one example and the action of a second non-return valve applicable to the compression storage bag according to a preferred embodiment of the present invention. In this preferred embodiment, especially when compression-storing the goods to be stored W using suction equipment such as a vacuum cleaner, a second non-return valve 120 is used. In this preferred embodiment, for example as in FIG. 1, a second non-return valve 120 is arranged and installed on the longitudinally central position on one side of the storage bag main body 12.

The second non-return valve 120 is formed, for example, of a synthetic resin material and preferably has a flat and tubular form, and is also constructed with one longitudinal end side of the second non-return valve 120 extending into the interior of the storage bag main body 12, and the other longitudinal end side extending to the exterior. That is, the second non-return valve 120 has an outer valve portion 122 that has one opening portion 120*a* arranged outside the storage bag main body 12. The second non-return valve 120 also has an inner valve portion 124 that has the other opening 120*b* arranged inside the storage bag main body 12. The outer valve portion 122 and the inner valve portion 124 connect communicatively the inside and outside of the storage bag main body 12, through the opening portions 120*a* and 120*b*.

As a result, the opening portions 120*a* and 120*b* of the second non-return valve 120 function as the suction mouth through which air is sucked out of the storage bag main body 12, causing the interior of the storage bag main body 12 to be in a negative pressure state. In this preferred embodiment, the outer side of the longitudinally central portion of the second non-return valve 120 is fixed to the inner surface of the storage bag main body 12, by a fixing device such as melt-adhesion or adhesion or other suitable fixing devices or material. The second non-return valve 120 is fixed to the inner surface of the storage bag main body 12, so that one opening portion 120*a* and the other opening portion 120*b* do not get clogged.

It should be noted that, the location of the second non-return valve 120 is not limited to the position described in the preferred embodiment described above. It can be arranged and installed, for example, on a portion on any other side of the storage bag main body 12 except the opening portion 14 side, or arranged and installed on a portion on one principle surface or the other principle surface of the storage bag main body 12.

In this preferred embodiment of the compression storage bag 10, when compression-storing the goods to be stored W using suction equipment such as the vacuum cleaner, the suction nozzle of the vacuum cleaner is inserted into the opening portion 120*a* of the outer valve portion 122 of the second non-return valve 120, and the suction operation is performed. As the suction operation continues and the size of the entire bag main body 12 is compressed and reduced, and the interior of the bag main body 12 is caused to be in a negative pressure state, the inner surfaces of the inner valve portion 124 adheres closely to each other, and the opening portions 120*a* and 120*b* of the second non-return valve 120 are hermetically sealed. Then, the opening portion 120*a* of the outer valve portion 122 is melt-adhered by heating apparatuses such as irons, and is completely closed.

That is, as is shown in FIG. 9, since a force that presses down on the outer surface of the inner valve portion 124 is generated, due to the pressure difference between the interior of the bag main body 12 and the outside ambient air, the inner surfaces of the inner valve portion 124 adhere closely to each other. The inner valve portion 124 cuts off and prevents the inflow of outside air into the bag main body 12, and the outflow of air from inside the bag main body 12.

In the compression storage bag 10 of the preferred embodiment described above, suction equipment such as a vacuum cleaner can be used, or in some cases the compression-storing operation can be done manually without using suction equipment, if necessary. Whether to use suction equipment depends on the kind and number of the goods to be stored, and depends on the circumstances of the compression-storing operation.

Figure 10:
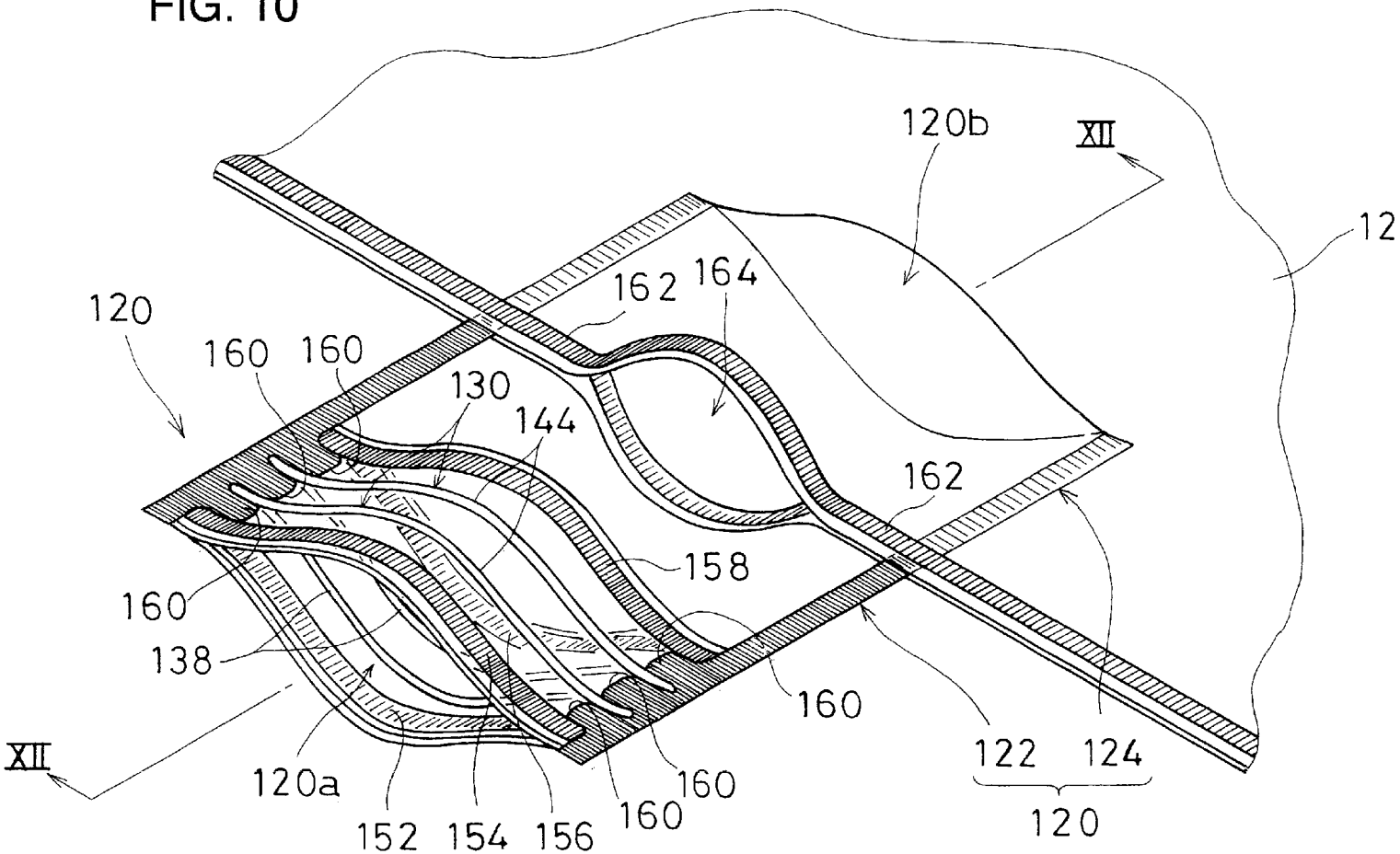
FIG. 10 is a perspective view of the principal elements, showing another example of a second non-return valve included in the compression storage bag of a preferred embodiment of the present invention.
Figure 11:
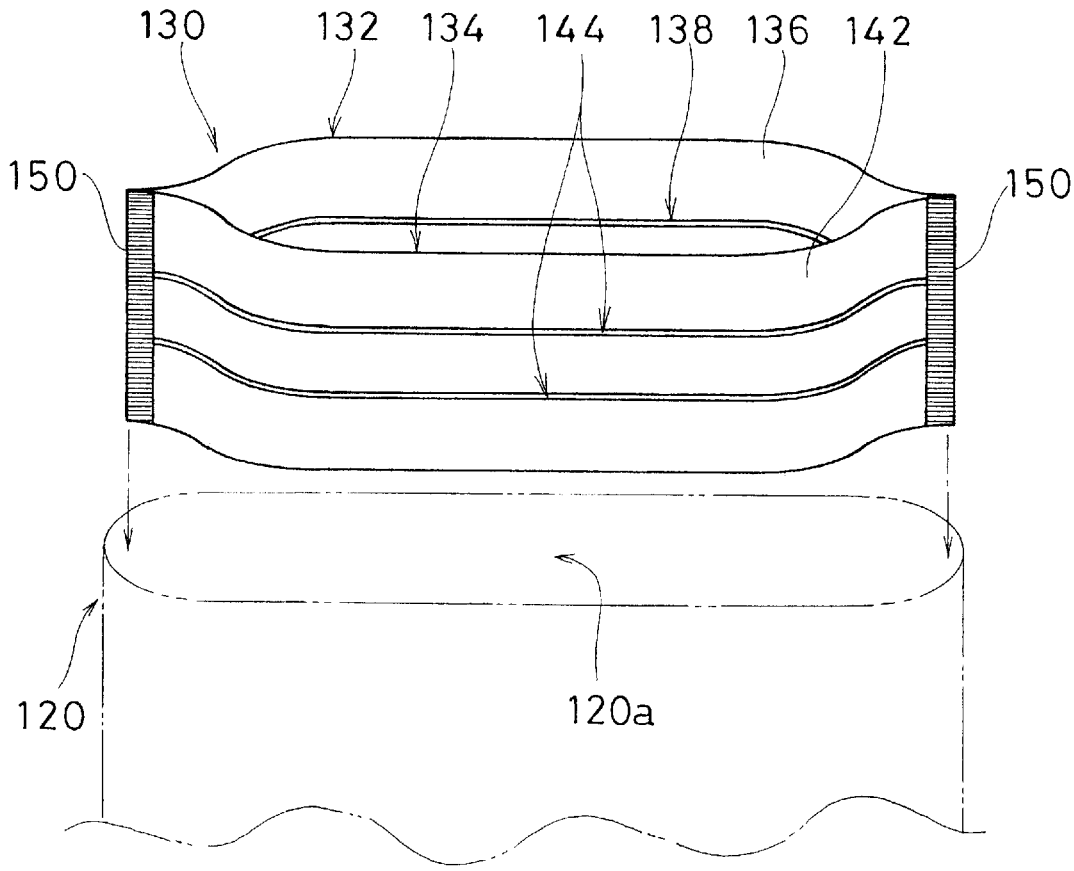
FIG. 11 is an exploded perspective view, showing the principal portion of the mounting structure of the blocking fastener on the second non-return valve in FIG. 10.
Figure 12:
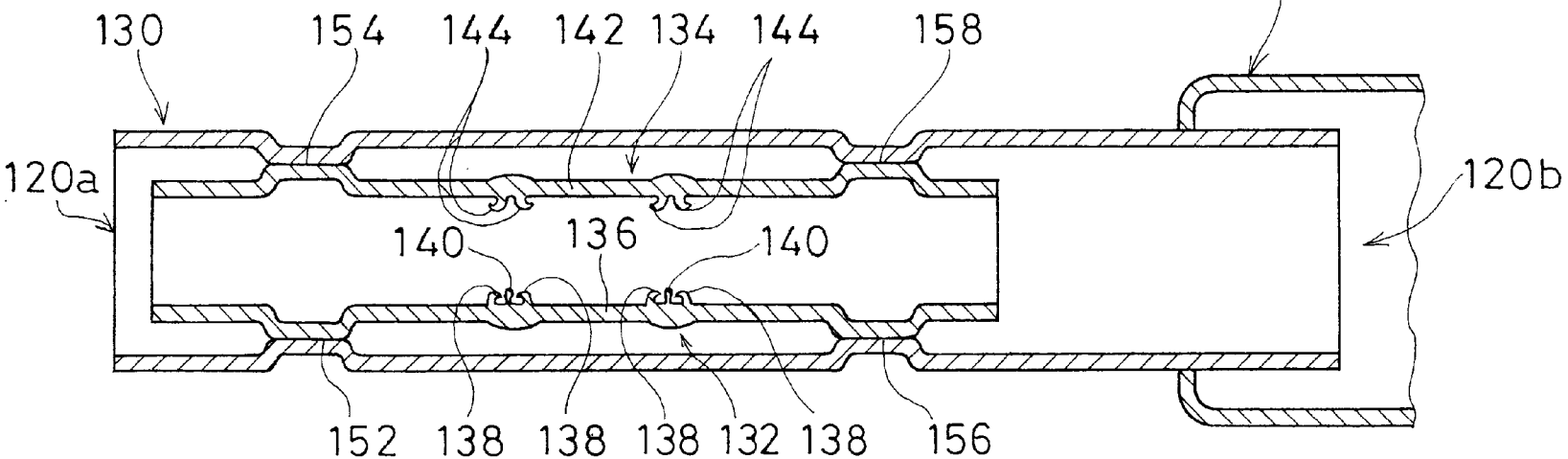
FIG. 12 is a sectional view taken along the XII—XII line of FIG. 10.
Figure 13:
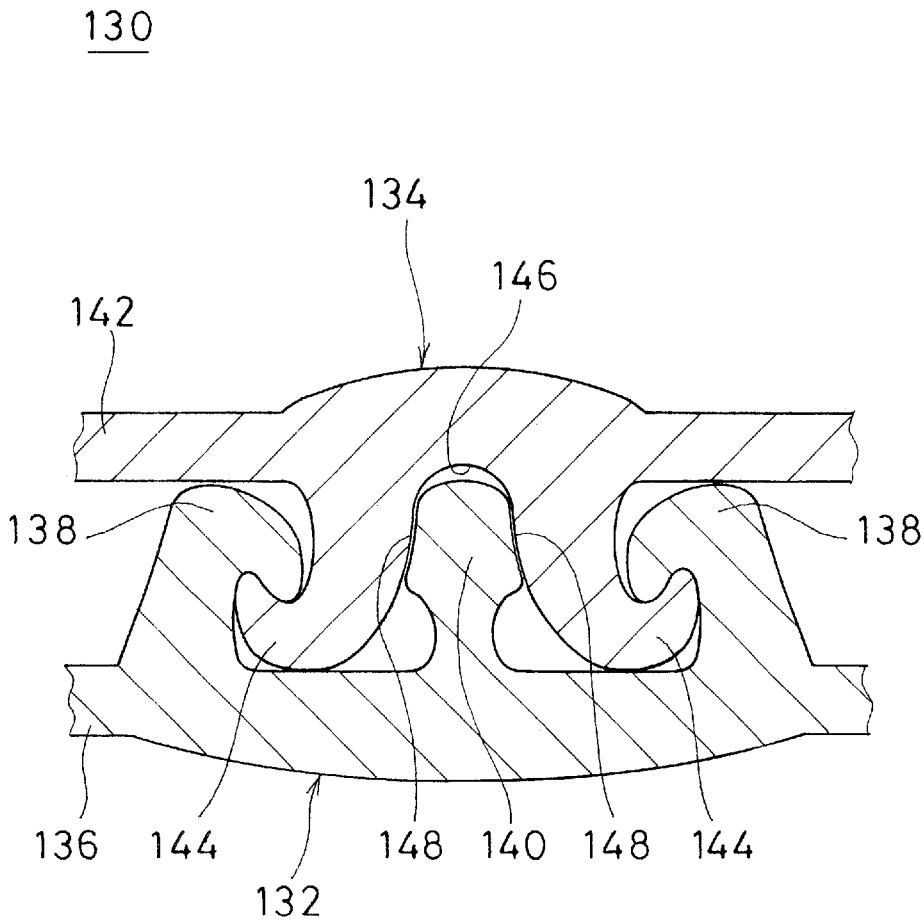
FIG. 13 is a sectional illustrated view of the principal portion, showing the fastened state of the male half-member and the female half-member of the blocking fastener on the second non-return valve in FIG. 10.

FIG. 10 is a perspective view of the principal portion, showing another example of a second non-return valve applicable to the compression storage bag according to a preferred embodiment of the present invention. FIG. 11 is an exploded perspective view showing the principal portion of the mounting structure of the blocking fastener on the second non-return valve in FIG. 10. FIG. 12 is a sectional view taken along the XII—XII line of FIG. 10. FIG. 13 is a sectional illustrated view of the principal portion, showing the fastened state of the male half-member and the female half-member of the blocking fastener on the second non-return valve in FIG. 10. The second non-return valve 120 shown in FIG. 10 to FIG. 13, differs particularly from the second non-return valve 120 described in the previous preferred embodiment, in that the blocking fastener freely blocks the opening portion 120*a* of the second non-return valve 120.

That is, a substantially flat and ellipse-ring shaped blocking fastener 130, for example, is provided on the internal circumferential plane of the outer valve portion 122 of the second non-return valve 120 shown in FIG. 10 to FIG. 13. The blocking fastener 130 preferably includes the male half-member 132, and the female half-member 134 that meshes with the male half-member 132. The male half-member 132 includes a first belt portion 136. In the first belt portion 136, two rows of female hook claws 138, for example, that extend in the longitudinal direction are provided. Two rows of female hook claws 138 are provided in the width direction of the first belt portion 136, with a predetermined interval disposed therebetween. Furthermore, on the inner sides between the two rows of female hook claws 138, one row of press down ribs 140 is provided, extending in the longitudinal direction of the first belt portion 136.

On the other hand, the female half-member 134 includes a second belt portion 142. Two rows of male hook claws 144 are provided in the second belt portion 142, which is mated together with the female hook claws 138. The two applicable male hook claws 144 have a wider base that is opposite to the hook (inside), and a groove portion 146 that has an arc formed section is arranged and installed between the two applicable male hook claws 144. A tightening wall 148 made of a curved surface is formed, on the inner side surface between the two applicable male hook claws 144. This tightening wall 148 can be a plane or a curved surface, so long as it can be hermetically sealed by pressure contacting to the press down rib 140. In this case, it is preferred from a manufacturing viewpoint, that the tightening wall 148 having a curved surface with only a minimal curvature.

It should be noted that, it is not easy to achieve precision of form in the molding process, in the combination of the press down rib 140 and the tightening wall 148. Hence, it is preferred that one of them be rigid, and the other one be elastic, so as to increase the hermetically sealing. In this preferred embodiment, the male half-member 132 and female half-member 134 are preferably made of synthetic resin material, such as high density polyethylene.

The male half-member 132 and the female half-member 134 preferably have a flat ring configuration, as is particularly shown in FIG. 11, so that the male half-member 132 and the female half-member 134 oppose each other. This is done by having both of the opposing longitudinal ends being heat-fused by a heat-fusing method such as a heat sealing method and a melt sealing method. In this way, the blocking fastener 130 having a flat ring configuration that has the sealing portions 150 on both sides is provided. It should be noted that, an impulse heat sealing method, an impulse melt sealing method, a high-frequency sealing method, or a ultrasonic sealing method, for example, can be used as a heat-fusing method as applicable.

The blocking fastener 130, as is particularly shown in FIG. 10 to FIG. 12 for example, is fixed to the circumferential edge portion of the opening portion 120*a* of the outer valve portion 122. In other words, the inner surface of the circumferential edge of the opening 120*a* in the outer valve portion 122, and outer surface of one end side of the first belt portion 136 are fixed together by sealing portions 152 and 154 that are sealed by a heat-fusing method or other suitable method. Similarly, the outer surface of the other end side of the first belt portion 136, and the inner surface of the outer valve portion 122 are fixed together by the sealing portions 156 and 158. In this case, two rows of female hook claws 138 and male hook claws 144 are arranged between the sealing portions 152, 154 and the sealing portions 156, 158, when viewed in the longitudinal direction of the outer valve portion 122.

Furthermore, one longitudinal end portion and the other end portion of the blocking fastener 130 are melted and adhered, to one radial end portion and the other end portion of the outer valve portion 122 respectively, with the sealing portions 150. In this case, substantially U-shaped sealing portions 160, for example, are provided on one longitudinal end portion of the blocking fastener 130, as is particularly shown in FIG. 10. These sealing portions 160 are provided between the sealing portions 152 and 154, and one pair of the female hook claws 138 and the male hook claw 144. These sealing portions 160 are also provided between one pair of the female hook claws 138 and the male hook claw 144, and the other pair of the female hook claws 138 and the male hook claw 144. These sealing portions 160 are also provided between the other pair of the female hook claws 138 and the male hook claw 144, and the sealing portions 156 and 158. These sealing portions 160 are arranged to protrude inside, from one longitudinal end portion and the other end portion of the blocking fastener 130.

As a result, in this preferred embodiment, the size of the opening diameter of the opening portion 120*a* of the outer valve portion 122 is preferably smaller, due to the plurality of sealing portions 160, compared to when the sealing portions 160 are not formed. In other words, these sealing portions 160 function as restricting portions so as to restrict the opening width of the opening portion 120*a* of the outer valve portion 122.

Furthermore, in this preferred embodiment, a communicative connection portion 164 between the outer valve portion 122 and the inner valve portion 124 is restricted by the sealing portion 162. Hence, the opening width of the communicative connection portion is smaller than the opening portion 120*a* of the outer valve portion 122.

As a result, in this preferred embodiment, air leaking from the opening portion 120*b* side of the inner valve portion 124, which is the air leaking from the storage bag main body 12, and inflow of outside air into the storage bag main body 12, is minimized.

Figure 14:
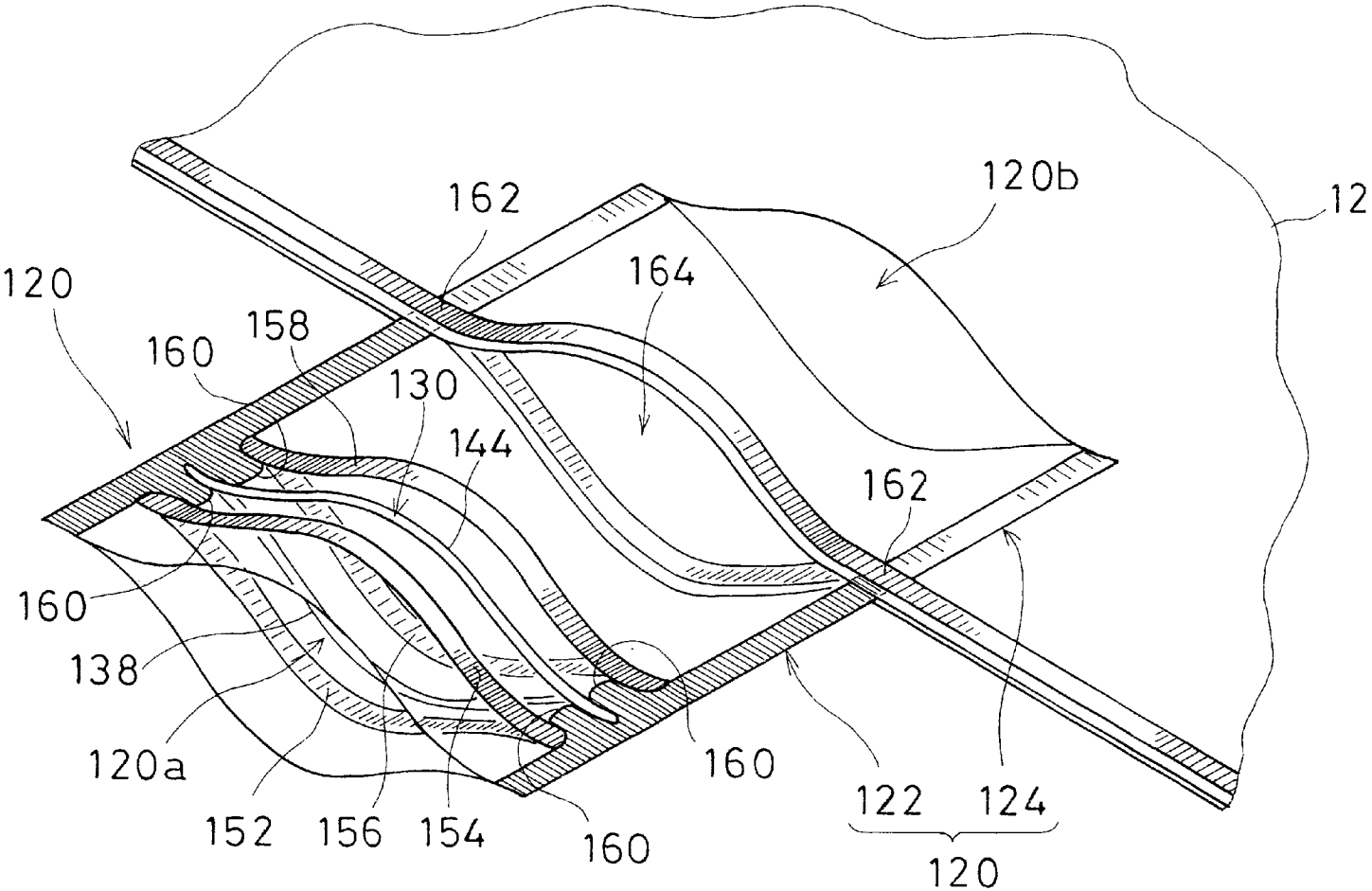
FIG. 14 is a perspective view of the principal elements, showing yet another example of a second non-return valve included in the compression storage bag of a preferred embodiment of the present invention.

FIG. 14 is a perspective view of the principal portion, showing yet another example of a second non-return valve applicable to the compression storage bag according to a preferred embodiment of the present invention. In this preferred embodiment, the number of the female hook claws 138 and the male hook claws 144 of the blocking fastener 130, and the opening width of the communicative connecting portion 164 are particularly different compared to the second non-return valve 120 in the above-described preferred embodiment.

That is, whereas there being two rows of female hook claws 138 and male hook claws 144 in the outer valve portion 122 of the second non-return valve 120 in the above-described preferred embodiment, the outer valve portion 122 of the second non-return valve 120 shown in FIG. 14 has only one row of female hook claws 138 and one row of male hook claw 144 mated together.

It should be noted that, in each of preferred embodiments described above, the second non-return valve 120 is formed unitarily preferably of a laminated film, which includes multiple plastic films superimposed together. In this case, the second non-return valve 120 is formed, for example, by a comparatively soft laminated film that is laminated in the following order: drawing nylon—polyethylene (molten polyethylene)—linear low-density polyethylene—polyethylene (molten polyethylene)—ethylene vinyl acetate copolymer (EVA).

In various preferred embodiments of the present invention, a compression storage bag is constructed to allow suction equipment such as a vacuum cleaner to be used, or in some cases the compression-storing operation can be done manually without using suction equipment, if necessary, depending on the kind and number of the goods to be stored, and depending on the circumstances of the compression-storing operation.

While preferred embodiments of the invention have been described above, it is to be understood that variations and modifications will be apparent to those skilled in the art without departing the scope and spirit of the invention. The scope of the invention, therefore, is to be determined solely by the following claims.

What is claimed is:

1. A compression storage bag comprising:

a storage bag main body having an entrance-exit portion for putting in and taking out goods to be stored;

a first non-return valve being arranged so that a first end of the first non-return valve extends to an interior of said storage bag main body, and a second end of the first non-return valve extends to a path connected communicatively to an exterior of said storage bag main body;

an outlet arranged and installed on an end edge of said storage bag main body on a side opposite to said entrance-exit portion, and arranged to allow air inside said storage bag main body to flow out through said first non-return valve and said path;

an open-close device arranged to enable said entrance-exit portion to be freely opened and closed; and a second non-return valve arranged at a different location than a location of said first non-return valve, and having an opening portion arranged to suck air out of an interior of said storage bag main body; wherein said compression storage bag includes a hanging device arranged to hang and support said storage bag main body at a desirable place, and said hanging device includes a support member that supports said storage bag main body, the support member being arranged and installed detachably on the opposite side of said entrance-exit portion of said storage bag main body, and a swiveling hook member being detachably installed on said support member; and said support member includes:

a pair of sandwiching plates arranged to be freely opened and closed, and sandwiching an end portion of said storage bag main body, on an opposite side of said entrance-exit portion;

a fitting portion arranged and installed on a longitudinally central portion of said pair of sandwiching plates, and having a latching hole piercing therethrough, said hook member being detachably sandwiched into the fitting portion; and a clamping device with which a space between one of said sandwiching plates and the other of said sandwiching plates is clamped, when said storage bag main body is sandwiched between said pair of sandwiching plates.

2. The compression storage bag according to claim 1, wherein said second non-return valve includes an inner valve portion extending to the interior of said storage bag main body, and an outer valve portion being connected communicatively to the inner valve portion, and extending out to the exterior of said storage bag main body.

3. The compression storage bag according to claim 1, wherein said storage bag main body has a first non-return valve group including a plurality of said first non-return valves being arranged and installed at intervals so as to be spaced from each other.

4. The compression storage bag according to claim 1, wherein said second non-return valve includes a blocking fastener arranged to block airflow between said storage bag main body and the exterior thereof, and said blocking fastener is equipped with a first belt, a hook claw extending in a longitudinal direction of said first belt, a second belt, and another hook claw formed extending in a longitudinal direction of said second belt, and being fitted with the hook claw of said first belt; and wherein said first belt and said second belt have a flat annular shape including mutually opposing sides extending in the longitudinal direction fixed together, the fixed portion being fixed to a radial end portion of said outer valve portion.

5. The compression storage bag according to claim 4, wherein said blocking fastener includes:

a plurality of female hook claws extending in the longitudinal direction of said first belt, the female hook claws being arranged to extend in a width direction of said first belt at intervals so as to be spaced from each other; and a plurality of male hook claws extending in the longitudinal direction of said second belt, the male hook claws being arranged to extend in a width direction of said second belt at intervals so as to be spaced from each other; wherein said plurality of female hook claws and said plurality of male hook claws are fitted with each other.

6. The compression storage bag according to claim 1, wherein said clamping device includes a plurality of button portions being arranged and installed on one of said sandwiching plates in the longitudinal direction at predetermined intervals, and having elastic portions; and a plurality of buttonhole portions being arranged and installed on said other sandwiching plate in the longitudinal direction at predetermined intervals, said button portions being secured to the buttonhole portions, and wherein said button portion has flat-planes on both sides in a radial direction, and said buttonhole portion has an arc portion and a straight-line portion corresponding to said flat-plane at a circumferential edge thereof, and a width between said straight-line portion on said buttonhole portion being slightly smaller than that of said elastic portion.

7. The compression storage bag according to claim 1, wherein said hook member includes:

an annular frame base;

a latching piece having a latching hole and being arranged and installed opposing said base and being latched to said fitting portion;

a hook neck-piece extending from said base piece in a direction opposite to a direction in which said latching piece extends; and a hook body being arranged and installed so as to be free to swivel via a hinge portion disposed on an end edge portion of said hook neck-piece; and wherein said latching piece is arranged to apply an elastic force that acts against a force acting in a direction moving away from said base piece.

8. The compression storage bag according to claim 7, wherein said latching piece includes:

a projecting member arranged to expand toward one side of said latching piece, and fitting to the latching hole of said fitting portion;

a thin-wall guide portion being arranged and installed on a portion of said projecting member to facilitate a front tip of said latching piece fitting along a plane on said fitting portion; and a convex shaped fall-out prevention piece that is latched to an edge end of said latching hole, when said projecting member is fitted to the latching hole of said support member.

9. A compression storage bag comprising:

a storage bag main body having an entrance-exit portion for putting in and taking out goods to be stored;

a first non-return valve being arranged so that a first end of the first non-return valve extends to an interior of said storage bag main body, and a second end of the first non-return valve extends to a path connected communicatively to an exterior of said storage bag main body;

an outlet arranged and installed on an end edge of said storage bag main body on a side opposite to said entrance-exit portion, and arranged to allow air inside said storage bag main body to flow out through said first non-return valve and said path;

an open-close device arranged to enable said entrance-exit portion to be freely opened and closed; and a second non-return valve arranged at a different location than a location of said first non-return valve, and having an opening portion arranged to suck air out of an interior of said storage bag main body; wherein said compression storage bag includes a hanging device arranged to hang and support said storage bag main body at a desirable place, and said hanging device includes a support member that supports said storage bag main body, the support member being arranged and installed detachably on the opposite side of said entrance-exit portion of said storage bag main body, and a swiveling hook member being detachably installed on said support member; and said hook member includes:

an annular frame base;

a latching piece having a latching hole and being arranged and installed opposing said base and being latched to said fitting portion;

a hook neck-piece extending from said base piece in a direction opposite to a direction in which said latching piece extends; and a hook body being arranged and installed so as to be free to swivel via a hinge portion disposed on an end edge portion of said hook neck-piece; and wherein said latching piece is arranged to apply an elastic force that acts against a force acting in a direction moving away from said base piece.

10. The compression storage bag according to claim 9, wherein said second non-return valve includes an inner valve portion extending to the interior of said storage bag main body, and an outer valve portion being connected communicatively to the inner valve portion, and extending out to the exterior of said storage bag main body.

11. The compression storage bag according to claim 9, wherein said storage bag main body has a first non-return valve group including a plurality of said first non-return valves being arranged and installed at intervals so as to be spaced from each other.

12. The compression storage bag according to claim 9, wherein said second non-return valve includes a blocking fastener arranged to block airflow between said storage bag main body and the exterior thereof, and said blocking fastener is equipped with a first belt, a hook claw extending in a longitudinal direction of said first belt, a second belt, and another hook claw formed extending in a longitudinal direction of said second belt, and being fitted with the hook claw of said first belt; and wherein said first belt and said second belt have a flat annular shape including mutually opposing sides extending in the longitudinal direction fixed together, the fixed portion being fixed to a radial end portion of said outer valve portion.

13. The compression storage bag according to claim 12, wherein said blocking fastener includes:

a plurality of female hook claws extending in the longitudinal direction of said first belt, the female hook claws being arranged to extend in a width direction of said first belt at intervals so as to be spaced from each other; and a plurality of male hook claws extending in the longitudinal direction of said second belt, the male hook claws being arranged to extend in a width direction of said second belt at intervals so as to be spaced from each other; wherein said plurality of female hook claws and said plurality of male hook claws are fitted with each other.

14. The compression storage bag according to claim 9, wherein said support member includes:

a pair of sandwiching plates arranged to be freely opened and closed, and sandwiching an end portion of said storage bag main body, on an opposite side of said entrance-exit portion;

a fitting portion arranged and installed on a longitudinally central portion of said pair of sandwiching plates, and having a latching hole piercing therethrough, said hook member being detachably sandwiched into the fitting portion; and a clamping device with which a space between one of said sandwiching plates and other said sandwiching plate is clamped, when said storage bag main body is sandwiched between said pair of sandwiching plates.

15. The compression storage bag according to claim 14, wherein said clamping device includes a plurality of button portions being arranged and installed on one of said sandwiching plates in the longitudinal direction at predetermined intervals, and having elastic portions; and a plurality of buttonhole portions being arranged and installed on said other sandwiching plate in the longitudinal direction at predetermined intervals, said button portions being secured to the buttonhole portions, and wherein said button portion has flat-planes on both sides in a radial direction, and said buttonhole portion has an arc portion and a straight-line portion corresponding to said flat-plane at a circumferential edge thereof, and a width between said straight-line portion on said buttonhole portion being slightly smaller than that of said elastic portion.

16. The compression storage bag according to claim 9, wherein said latching piece includes:

a projecting member arranged to expand toward one side of said latching piece, and fitting to the latching hole of said filling portion;

a thin-wall guide portion being arranged and installed on a portion of said projecting member to facilitate a front tip of said latching piece fitting along a plane on said fitting portion; and a convex shaped fall-out prevention piece that is latched to an edge end of said latching hole, when said projecting member is fitted to the latching hole of said support member.

* * * * *

UNITED STATES PATENT AND TRADEMARK OFFICE

CERTIFICATE OF CORRECTION

PATENT NO. : 6,622,857 B2 
DATED : September 23, 2003
INVENTOR(S) : Ryoichi Ohtsubo and Yoshihiro Koyanagi It is certified that error appears in the above-identified patent and that said Letters Patent is hereby corrected as shown below:

Title page,
Item [73], should read -- Assignees: Aru Corporation, Nara-ken (JP)
Kashiwara Seitai Co., Ltd., Osaka-fu (JP) --

Signed and Sealed this

Sixth Day of April, 2004

JON W. DUDAS
*Acting Director of the United States Patent and Trademark Office*